United States Patent [19]

DeMars

[11] Patent Number: 4,694,146

[45] Date of Patent: Sep. 15, 1987

[54] BRACKET MOUNTED TOWEL DRYING CABINET

[76] Inventor: Robert A. DeMars, 7932 Maestro Ave., Canoga Park, Calif. 91304

[21] Appl. No.: 791,735

[22] Filed: Oct. 28, 1985

[51] Int. Cl.[4] ..... H05B 3/30

[52] U.S. Cl. ..... 219/524; 219/521; 219/385; 34/151

[58] Field of Search ..... 219/524, 200, 201, 521, 219/385, 386; 34/151, 237, 238, 239

[56] References Cited

U.S. PATENT DOCUMENTS

| | | | |
|---|---|---|---|
| 299,986 | 6/1984 | Jervis | 34/238 |
| 2,485,140 | 10/1949 | Cordero | 219/524 |
| 2,571,918 | 10/1951 | Meninger | 219/385 |
| 2,852,861 | 9/1958 | Jarrell | 34/151 |
| 3,626,152 | 12/1971 | Governale | 219/385 |
| 4,117,309 | 9/1978 | Cayley | 219/385 |

FOREIGN PATENT DOCUMENTS

| | | | |
|---|---|---|---|
| 304708 | 1/1933 | Italy | 219/524 |
| 54-44263 | 4/1979 | Japan | 34/151 |

*Primary Examiner*—E. A. Goldberg
*Assistant Examiner*—Teresa J. Walberg
*Attorney, Agent, or Firm*—Cislo & Thomas

[57] ABSTRACT

A cabinet for heating cloth material such as towels, is provided, capable of mounting on a towel rack or other support. The cabinet of the invention, which is capable of warming or drying towels or other cloth materials, includes a pair of opposed covers which are hingedly attached along one edge, a metal plate for supporting a towel, the metal plate being surrounded by resistance heating elements and being hingedly attached intermediate the two covers, associated circuitry for providing power to the resistance heating elements and brackets for mounting the cabinet on a wall-mounted towel rack.

5 Claims, 5 Drawing Figures

BRACKET MOUNTED TOWEL DRYING CABINET

BACKGROUND OF THE INVENTION

This invention relates to a towel drying cabinet, and, more particularly, to a bracket mounted towel drying cabinet for use in drying or warming towels or other cloth material.

The feel of a warm towel against the skin immediately after a shower is one of life's enjoyable pleasures. However, it is one that is only rarely, if ever, enjoyed at home, since it requires the concomitant use of a clothes dryer. It is even more rare to experience such a sensation in a place of lodging away from home, such as a hotel or motel.

Further, as much as a warm towel may be desired, there are times when one has only a wet towel and no access to a dry towel. While at home there may be a supply of extra towels, such is not always the case at a place of lodging away from home.

Accordingly, a need exists for apparatus suitable for warming or drying a towel or other cloth material.

OBJECTS AND SUMMARY OF THE INVENTION

It is an object of the present invention to provide apparatus for warming and drying towels and other cloth materials.

It is another object of the present invention to provide such apparatus which may be conveniently mounted on a bracket such as a towel rack.

These and further objects of the invention will become more readily apparent upon a consideration of the following commentary taken in conjunction with the drawing.

Briefly, the bracket mounted towel drying cabinet of the invention comprises a housing comprising two opposed covers, hingedly attached by a hinge means along one side and defining an enclosed space upon closure, means for supporting and providing heat to a towel in the enclosed space, the support means being hingedly attached intermediate the two covers, means for heating the support means and means for mounting the cabinet on a bracket.

DETAILED DESCRIPTION OF THE PREFERRED EMBODIMENTS

Figure 1:
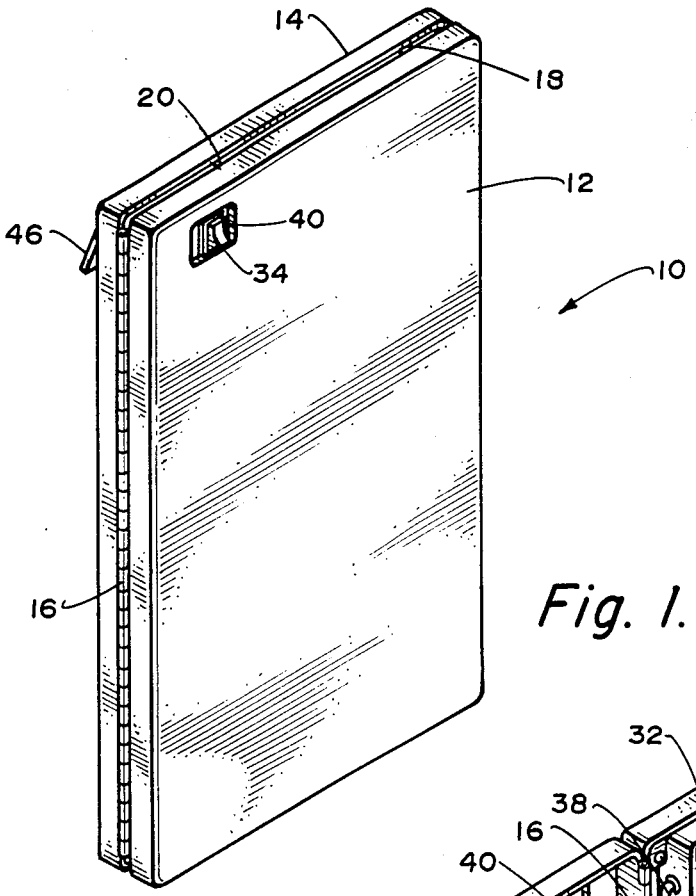
FIG. 1 is a perspective view of the bracket mounted towel drying cabinet of the invention, depicted in the closed position.
Figure 2:
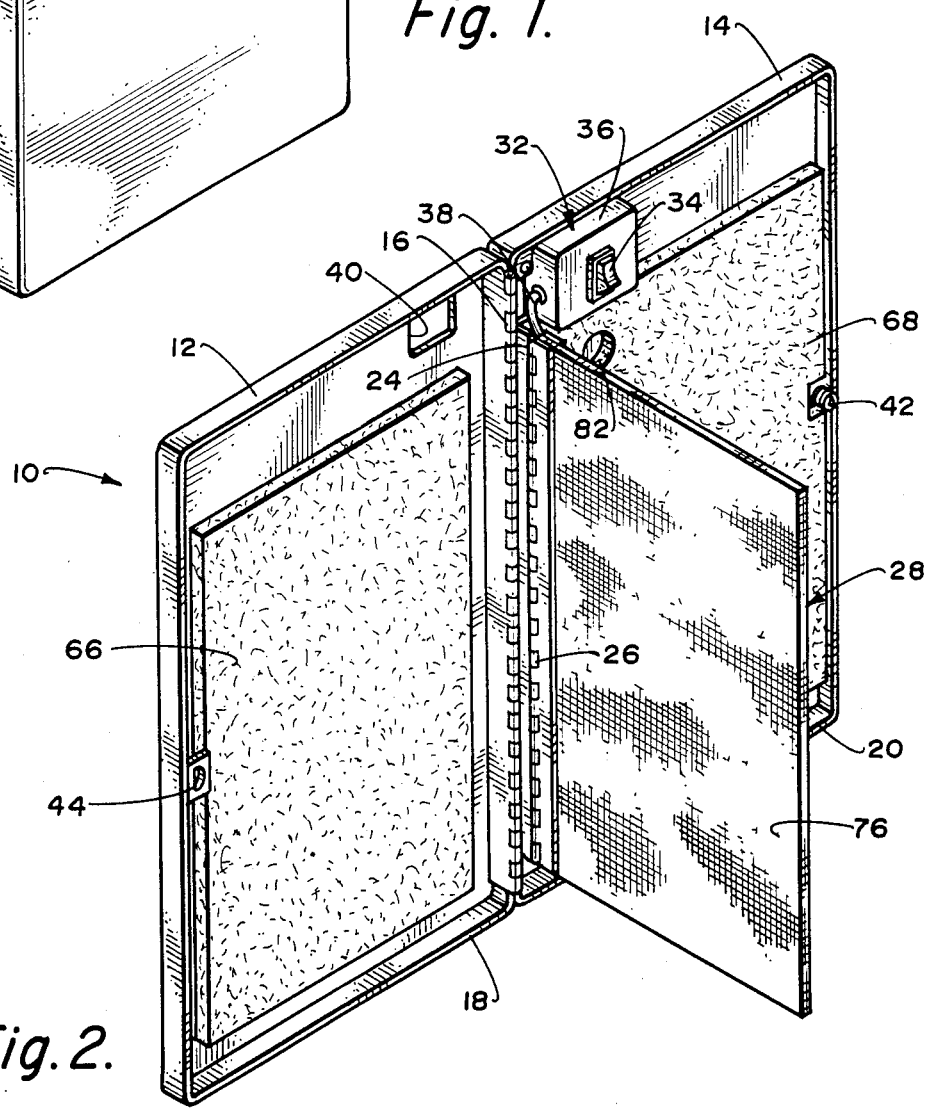
FIG. 2 is the towel drying cabinet of the invention, depicted in the open position.
Figure 5:
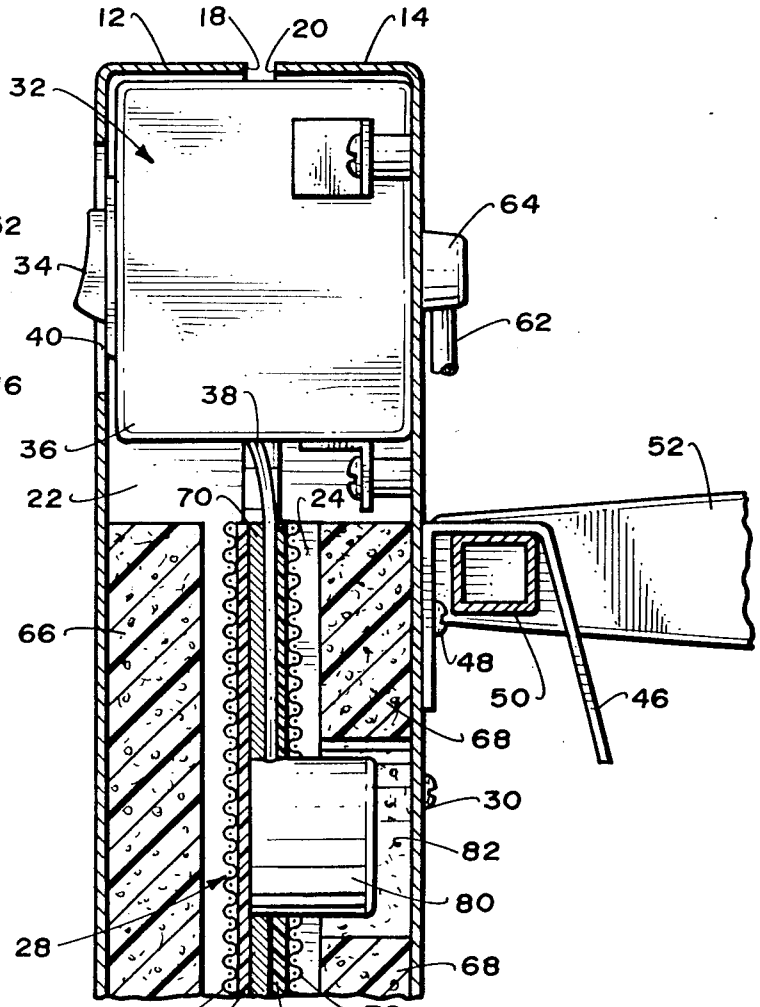
FIG. 5 is a cross-sectional view of the upper portion of the towel drying cabinet of the invention taken along the line 5—5 of FIG. 4.

Referring now to the drawing wherein like numerals of reference represent like elements throughout, a towel drying cabinet is generally depicted at 10. The towel drying cabinet 10 comprises a first cover 12 and a second cover 14, hingedly connected by a continuous hinge means 16 along one side of each cover. The covers 12, 14 are provided with respective opposed surfaces 18, 20 which, upon closure of covers 12, 14, defines an enclosed space 22.

Intermediate the covers 12, 14 and hingedly attached to an L-shaped bracket 24 by a continuous hinge 26 is a support means 28 for supporting a towel (not shown). The L-shaped bracket 24 is attached to the second cover 14 by a series of screws 30. The towel support means 28 includes a rigid heater, described below, preferably operating on the principle of resistance heating, which is capable of providing heat to the towel while at the same time capable of supporting the towel.

Control means 32 mounted on the inside of second cover 14 is provided for heating the towel support means 28 and comprises a rocker switch 34 mounted in an enclosure 36, with electrical cable 38 for connection between the control means 32 and the towel support means 28.

An opening 40 defined in the first cover 12 permits access to the rocket switch 34 when the cabinet is closed, as shown in FIG. 1.

The two mating covers 12, 14 are provided with a latch means comprising a male connector 42 and female receptacle 44, in order to secure the two mating covers 12, 14 in a closed position. The latch is conveniently of the type such that pressing against the latch side releases the latch (push-push type).

Figure 4:
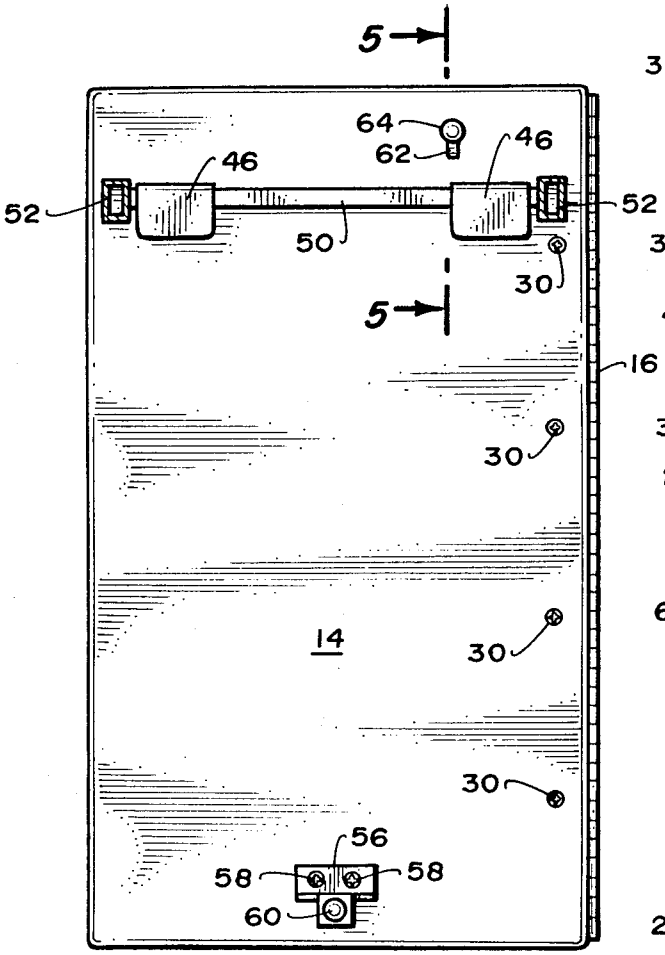
FIG. 4 is a view taken along the line 4—4 of FIG. 3, looking at the rear of the towel drying cabinet of the invention.

Means are provided for mounting the cabinet on a wall-supported bracket, such as a towel rack. The mounting means are partially shown in FIG. 1 and more completely shown in FIGS. 3 and 4. The mounting means comprises a pair of approximately U-shaped mounting brackets 46, which are affixed to the upper outside portion of the second cover 14 by fastening means such as screws 48. The mounting brackets 46 are adapted to slip over and engage any towel rack 50 of the type supported by end brackets 52 mounted on a wall 54.

In order to maintain the bracket mounted towel drying cabinet 10 of the invention in a substantially upright position, a spacer bracket 56 is provided, also affixed to the second cover 14, but near the bottom and approximately in the center thereof, by means such as screws 58. A rubber stopper foot 60 or other nonmarring device is provided at the end of the spacer bracket 56 to rest against the wall 54 to which the towel rack end brackets 52 are attached.

An electrical cable 62 for connection of the control means 32 to an AC source passes into the interior of the cabinet through a grommet fixture 64.

Insulation 66, 68 is provided along the inside of covers 12, 14, respectively. The insulation conveniently comprises a urethane foam and is held in place by a pressure-sensitive adhesive (not shown).

The towel support 28 comprises a metal plate 70, such as aluminum, to which is bonded on each of the two major surfaces thereof a silicone rubber heating element 72, 74 by a pressure-sensitive adhesive (not shown). A fiber glass window screen 76, 78 completely covers and protects both sides of the towel support 28 with its heating elements 72, 74. A thermostat 80, such as a snap-action thermostat, is incorporated in the heating element 72, 74, being electrically connecting therewith, and prevents overheating thereof. An opening 82 is provided as necessary in the insulation 68 to accommodate the thermostat 80.

Figure 3:
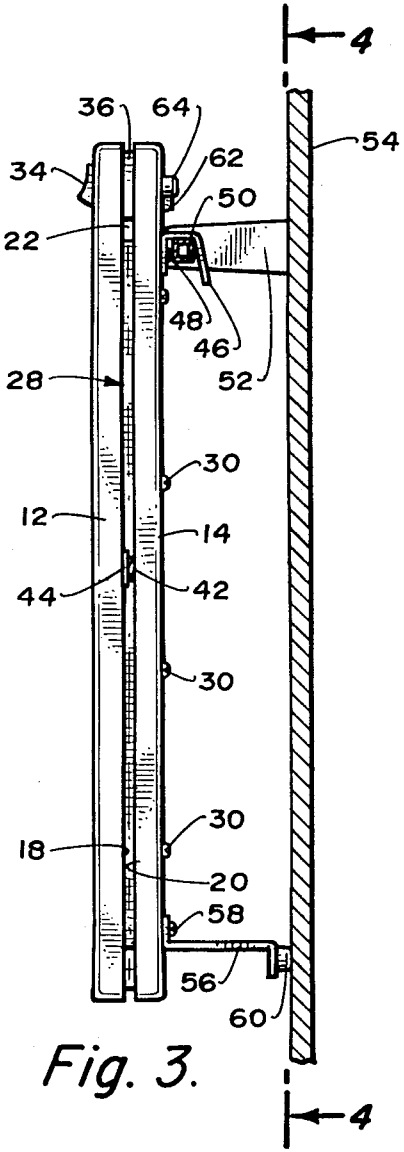
FIG. 3 shows the towel drying cabinet of the invention mounted on a bracket such as a towel rack attached to a wall.

In use, the towel drying cabinet of the invention is slipped over a towel bracket, as shown in FIG. 3. The pair of brackets 46 with spacer bracket 56 and stop 60 maintain the cabinet in a substantially upright position. The cord 62 is plugged into a convenient electrical outlet. A towel is hung over the towel support 28, the first cover 12 is latched to the second cover 14 and the switch 34 is turned on to provide power to the resistance heating element. The heating element 72, 74 is sized such that warming of the towel occurs in about two minutes. Pushing on the first cover 12 then releases the male connector 42 from the female receptacle 44, opening the covers 12, 14 and permitting access to the warmed towel.

It will be appreciated that not only may towels be warmed by use of the cabinet of the invention, but also wet towels may be dried and other cloth material may be warmed or dried as needed.

Thus, there has been disclosed a towel drying cabinet provided with brackets for conveniently mounting on a towel bracket attached to a wall. Various changes and modifications which are obvious will occur to those of skill in the art, and all such changes and modifications are considered to be within the scope of the invention, which is defined by the appended claims.

What is claimed is:

1. A bracket mounted cabinet for warming cloth material comprising:

(a) a housing comprising two opposing covers, hingedly attached by a first hinge means along one side and defining an enclosed space upon closure thereof;

(b) support and heating means for supporting and heating a towel within said enclosed space, said support means hingedly attached by a second hinge means intermediate said covers;

(c) means for providing power to said heating means; and (d) mounting means for mounting said cabinet on a bracket.

2. The cabinet of claim 1 wherein said opposing covers are provided with insulation means along inner surfaces thereof.

3. The cabinet of claim 1 wherein said means for providing power to said heating means comprises a switch for activation of said heating means and a thermostat for sensing the temperature and for switching said heating means on and off as required.

4. The cabinet of claim 1 wherein said mounting means includes a pair of mounting brackets adapted to fit over a towel rack, said pair of brackets mounted near a top portion of said cabinet, and a spacer bracket mounted near a bottom portion of said cabinet below said mounting brackets and adapted to maintain said cabinet in a substantially upright position.

5. A bracket mounted cabinet for warming cloth material comprising:

(a) a housing comprising two opposed covers, hingedly attached by a first hinge means along one side and defining an enclosed space upon closure thereof;

(b) support and heating means for supporting and heating a towel within said enclosed space, said support means hingedly attached by a second hinge means intermediate said covers, said support and heating means comprising:

(1) an inner rigid metal plate, and (2) a resistance heating element on at least one side of said plate;

(c) means for providing power to said heating means, comprising a switch for activation of said heating means and a thermostat for sensing a temperature and for switching said heating means on and off as required; and (d) means for mounting said cabinet on a bracket, comprising a pair of brackets adapted to fit over a towel rack, said pair of brackets mounted near a top portion of said cabinet, and a spacer bracket mounted near a bottom portion of said cabinet below said pair of brackets and adapted to maintain said cabinet in a substantially upright position.

* * * * *